US007272895B2

(12) United States Patent
La Gioia

(10) Patent No.: US 7,272,895 B2
(45) **Date of Patent: *Sep. 25, 2007**

(54) DOUBLE FLOW CAGE COMPACTOR DRYER APPARATUS AND METHOD OF COMPACTING AND DRYING WASTES

(76) Inventor: Antonio La Gioia, Corso Vittoria Colonna, 109, Marion (RM) (IT) 00047

( * ) Notice: Subject to any disclaimer, the term of this patent is extended or adjusted under 35 U.S.C. 154(b) by 0 days.

This patent is subject to a terminal disclaimer.

(21) Appl. No.: 10/530,210

(22) PCT Filed: Sep. 29, 2003

(86) PCT No.: PCT/IT03/00581

§ 371 (c)(1),
(2), (4) Date: Apr. 4, 2005

(87) PCT Pub. No.: WO2004/030901

PCT Pub. Date: Apr. 15, 2004

(65) Prior Publication Data

US 2006/0162181 A1 Jul. 27, 2006

(30) Foreign Application Priority Data

Oct. 4, 2002 (IT) ..... RM2002A0504

(51) Int. Cl.
*F26B 21/06* (2006.01)

(52) U.S. Cl. ..... 34/90; 34/210; 34/397; 210/497.01; 100/50

(58) Field of Classification Search ..... 34/380, 34/397, 90, 210; 100/50; 210/497.01
See application file for complete search history.

(56) References Cited

U.S. PATENT DOCUMENTS

| | | | | |
|---|---|---|---|---|
| 3,559,566 | A | 2/1971 | Aspegren et al. | |
| 4,451,331 | A * | 5/1984 | Raggam et al. | 162/18 |
| 5,119,722 | A | 6/1992 | Carter et al. | |
| 5,562,832 | A * | 10/1996 | McOnie et al. | 210/710 |
| 6,298,576 | B1 | 10/2001 | La Gioia | |

FOREIGN PATENT DOCUMENTS

| | | |
|---|---|---|
| DE | 516762 | 1/1931 |
| FR | 2127881 | 10/1972 |
| FR | 2701664 | 8/1994 |
| FR | 2744378 | 8/1997 |

* cited by examiner

*Primary Examiner*—S. Gravini
(74) *Attorney, Agent, or Firm*—Young & Thompson

(57) ABSTRACT

A cage drying—compacting apparatus for wastes, includes a cylindrical shape and at least a pair of pressure plates, the cylindrical body having heating longitudinal tubes, coursed by a thermal carrier fluid, provided along the generatrixes of the cylinder and spaced from each other to realize longitudinal slots for outlet of vapour but not for outlet of material, coupled by constraint hinge elements, positioned at a given distance between centres, and the pressure plates being placed opposed each other, operating as movable basis of the body and acting as pistons. Heat sources are, provided inside the apparatus, all along its length, the sources include at least a tube coursed by thermal carrier fluid, an inlet for the material to be treated, and elements for collecting the material.

12 Claims, 3 Drawing Sheets

DOUBLE FLOW CAGE COMPACTOR DRYER APPARATUS AND METHOD OF COMPACTING AND DRYING WASTES

BACKGROUND OF THE INVENTION

The present invention relates to a double flow cage compactor dryer apparatus and method of compacting and drying wastes.

The invention is included in the field of the apparatuses for treatment of industrial wastes, litter, or similar materials.

Disposal of urban solid wastes is an always more felt problem in the modern life. Solutions presently used provide the placement of the wastes in a dump, or, as alternative, the incineration.

Both these solutions have environmental drawbacks. In fact, most dumps quickly reach a saturation level and it is always more difficult to find new areas without protests of the inhabitants of the surrounding zones, worried about the air pollution due to the exhalation of wastes.

Instead, incinerators, even the most technologically advanced for the thermo-valorisation can produce power with efficiency close to 20%, let in the air large amounts of carbon dioxide for each ton of burned waste, beside having the risk due to the creation of toxic products in the fumes, mainly caused by the presence of a high degree of humidity in the refuses preventing to obtain a complete combustion.

Recently, modern plants are widely used, aiming to the contemporaneous volumetric reduction of the refuses and to the inertisation of the putrescent fraction. The goal of this technology is that of obtaining a solid, dry, sterilised and detoxified product that can be sent at the dump or even, in view of its excellent stability features and of its drying state, can be used as material for environmental restoring, i.e. as very good fuel to be used in the thermo-valorisation.

The kind of technical problems faced up and only partially solved by the known plants are mainly connected with the optimisation of the working potentiality and as a consequence to the high practice costs of the apparatuses.

For example, Italian patent for industrial invention N° 1,262,260 describes a two stage system: a first compaction stage, wherein the material to be treated is pressed at room temperature, de-watering the same before soaking up; and a second drying stage, wherein the pre-treated refuses are let within an oven, on the lateral wall of which a box-shaped element is provided along which a thermal carrier fluid passes to release heat to the material. During this second stage, residual water is eliminated from the refuses by evaporation and the vapour produced comes out through the openings realised on the lateral surface of the oven.

This kind of system has different drawbacks: in fact, it is not possible to obtain an even hydraulic set running of the thermal carrier fluid, thus jeopardising the optimisation of the thermal exchange; moreover, oven body resistance properties are not satisfying, also in presence of little pressure stresses, due to the openings on the lateral surface of the heating chamber necessary for the outlet of the vapour.

Still, presence of said lateral openings reduces the contact surface between the wastes and the heat zones, thus reducing the efficiency of the drying stage.

A more advanced solution is described in the EP patent N° 0 663 227 B1, relevant to a drying—compacting apparatus of the cage type for wastes, comprising a cylindrically shaped body containing wastes that must be treated and to sturdy pressing plates to compact the same, said pressing plates being opposed each other and operating as movable basis of said cylindrically shaped body.

With respect to the previous solution, EP patent N° 1 066 490 B1, filed in the name of the same Applicant, has innovative features allowing to obtain the best results. It describes a drying—compacting apparatus of the cage type, having a cylindrically shaped body comprised of longitudinal tubes along the generatrix of said cylindrically shaped body in such a way to be spaced each other, said tubes being coursed by a thermal carrier fluid, acting both as bearing structure of the apparatus and as heat exchange surface between said thermal carrier fluid and the wastes to be subjected td treatment contained within the cylindrically shaped body. Compaction action of the wastes is actuated by two pressure plates opposed each other, acting as movable basis for said cylindrically shaped body.

Heating tubes are constrained each other by retaining rims, set up with a given distance between centres to ensure stability of the tubes forming the cylindrically shaped body stressed by radial thrusts exerted by wastes during pressure and by thermal gradients.

Drying—compacting apparatus further provides outlet means for the steam generated during heating of said wastes, said means being comprised of longitudinal slots between heating tubes.

The system, as the other known solutions, requires a pre-treatment section, wherein wastes are pressed at room temperature to separate the surface liquid fraction comprised of the soaking water. An already de-watered load arrives to the drying—compacting apparatus, from which, by the further pressure—drying treatment, the residual water is extracted and at the same time the volume of the mass is further reduced.

Thus the system works according to a batch mode. In fact, wastes are fed to the pre-treatment section, wherein the first de-watering is carried out and from which they are extracted to be sent to the drying—compacting apparatus, wherein they are subjected to the inertisation before being withdrawn and sent to the storing.

The solution suggested according to the EP patent N° 1 066 490 B1 is such to avoid the hydraulic set running problems of the heating thermal carrier fluid and to solve in a clear way the problem of the outlet of the steam.

Furthermore, the completely original structure of the cage type drying—compacting apparatus is sturdy and perfectly resistant to the thermal and mechanical stresses developed during its operation.

At the same time, drying—compacting apparatus according to EP patent N° 1 066 490 B1 has some features reducing its efficiency.

First of all, thermal mode established within the wastes contained into the cylinder has a logarithmic run; slow growing of the temperature, toward the centre of the mass to be treated, jeopardise the reaching of the design temperatures and their uniform distribution in the product within a short time.

Further, positioning of the tubes along the generatrix of the cylindrical body unavoidably involves that the exchange surface really usable, i.e. really in touch with the material to be subjected to treatment, is only the one faced toward the inner part of the cylindrical body, i.e. a reduced percentage of the whole heating surface of the tubes.

These two limitations would impose opposed solutions, in fact, if on one end, to increase the useful fraction of the exchange surface, it would be necessary to increase the diameter of the cylindrical body comprising the drying—compacting apparatus, on the other end, the logarithmic run of the thermal curve would impose the construction of systems having reduced diameter, that would involve the necessity of realising longer systems or systems comprised of more than one drying—compacting apparatus, working in parallel, to maintain unmodified the same volumetric standard capability.

Finally, a further limitation is due to the difficulties of coordinating the synchronism of the loading, compaction and ejection cyclic sequences from the system, unavoidably bringing to the division of the operative flow into multiple steps spaced by long time intervals and consequently to a reduction of productivity.

Much better would be to have at disposal a less bulky drying—compacting apparatus able to process higher amount of refuses, thus reducing the drying process and allowing to operate continuously.

SUMMARY OF THE INVENTION

In this context it is included the solution according to the invention on the basis of which the above objects are reached by a cage like drying—compacting apparatus, structurally modified in such a way to increase the average useful fraction as exchange surfaces of the tubes coursed by the thermal carrier fluid and at the same time to allow the continuous operation of the system.

To obtain the above objects, it is suggested according to the present invention to introduce further heat sources within the cage drying —compacting apparatus, all along its length, suitably sized, comprised of tubes through which thermal carrier fluid passes. Additional tubes, beside being into the refuse mass, and consequently having a surface useful for thermal exchanging much higher than that of tubes comprising the outer perimeter of the cage, can be placed in such a way to divide the refuse drying—compacting apparatus into a plurality of sections all along its length, each section having a diameter equivalent minor than the diameter of the cage, and thus being more efficient to transmit heat to the refuse mass. Consequently, temperature of the treated mass reaches the required values in a reduced time.

Positioning of the tubes realised according to the present invention further allows to obtain a better resistance of the device to the mechanical and thermal stresses, with the consequence that it becomes possible to give to the cage drying—compacting apparatus also the pressing work that in the known systems is carried out in the compaction section at room temperature, placed upward the drying—compacting apparatus.

Elimination of the pre-treatment section allows, by a hopper, to directly feed the drying—compacting apparatus by the refuses to be subjected to treatment. As a consequence, it is possible to continuously operate the system.

Continuous operation has further advantages, among which:

a further reduction of the total treatment time,
increase of specific productivity,
reduction of modules comprising the system,
optimisation of the pushing rods,
reduction of the costs.

Drying—compacting apparatus according to the present invention can be conveniently used for drying and pressing every kind of solid refuses, having a humidity higher than 40%, both deriving from civil and industrial activity, in such amounts to be introduced within operative cycles, even 600-1000 t per each operative working shift, with the consequent reduction of the total managing costs for each Kg of treated refuses.

It is therefore specific object of the present invention a cage drying—compacting apparatus for wastes, comprising a cylindrical shape and at least a pair of pressure plates, said cylindrical body being comprised of heating longitudinal tubes, coursed by a thermal carrier fluid, provided along the generatrixes of the cylinder and spaced each other, in such a way to realise longitudinal slots for outlet of vapour but not for outlet of material, coupled by constraint hinge means, positioned at a given distance between centres, and said pressure plates being placed opposed each other, operating as movable basis of said cylindrical body and acting as pressing pistons, steam generated by the heating step of said wastes being discharged through the longitudinal slots between said heating tubes, said apparatus providing further heat sources, provided inside the cage drying—compacting apparatus, all along its length, said sources being comprised of at least a tube coursed by thermal carrier fluid, means for inlet of the material to be subjected to treatment, in a position close to one of the two ends of the apparatus, and means for collecting the material subjected to the treatment, in correspondence of the opposed end.

Particularly, according to the invention, said further heat sources comprise a plurality of tubes coursed by thermal carrier fluid and placed aligned, spaced each other, in such a way to divide the inner volume of the cylindrical body into sections connected each other, preferably into four equivalent sections, for each section being provided a pair of opposed pressure plates, shaped on the basis of the shape of each section.

According to the present invention, said pressure plates are shaped in such a way that the profile faced toward the outer surface of the cage, and possibly also the profile faced toward the further heat sources can have a straddle profile, in such a way that cusps defined between a straddle and the other are insinuate within the space between two adjacent tubes.

Particularly, according to the invention, said further heat sources are constrained by a containment structure, comprised of a plurality of constraint plates, provided at a set distance between centres.

Always according to the invention, the drying—compacting apparatus provides inlet and outlet manifolds for said thermal carrier fluid from the tubes, coupled by flexible joints, in such a way to allow a uniform distribution of the fluid within the tubes, preferably said manifolds being provided in such a way that the flow direction within each single tube is opposed to the one of the adjacent tube.

Still according to the present invention, said means for inlet of the material to be subjected to treatment comprise a loading hopper, from which refuses fall within a loading chamber at the inlet end of the cylindrical body.

Furthermore, according to the invention, said drying—compacting apparatus further comprise a thermo-insulating material case, tightly containing said cylindrical body, having a manifold function for the vapour exiting from said longitudinal slots and put in a depression mode by a closed cycle motor-condensing unit in such a way that said apparatus has no impact on the working environment and on the outer environment.

Always according to the invention, said constraint rims are mounted on a series of resting and sliding means creating a labile statically indeterminable structure in order to minimise the effects due to stresses deriving from the high thermal gradients, as well from the radial thrusts due to the compression forces exerted by the opposed pressure plates.

It is further a second specific object of the present invention a process of compacting and drying wastes by a drying—compacting apparatus as described in the above, that, a set running, includes the following steps, that are cyclically repeated:

withdrawing the pressure plates of both sides of the apparatus up to the respective lower death ends;

introducing within the drying—compacting apparatus, at the operative temperature, already containing an amount of refuses introduced during the previous cycles, a set loading amount of material to be subjected to treatment, operating the pressure plates of the material inlet side, in such a way that they press the introduced material with the new charge against the material already present within the cylindrical body of the drying—compacting apparatus, thrusting it in such a way that a fraction of the material, at the end opposite with respect to the inlet one of the material is made exiting, withdrawing the pressure plates from the side of inlet of the material up to the lower death end, taking the amount of material exited from the apparatus, operating the pressure plates of both the apparatus sides, in such a way that they will press the material therein, repeating the cycle of the first step.

According to the invention, set running operation conditions are reached by the following steps, starting from an empty apparatus:

making the thermal carrier fluid flowing within the tubes, to reach the operative temperatures, withdrawing the pressure plates of both sides of the apparatus up to the relevant lower death points, introducing a batch of the waste to be subjected to the treatment within the drying—compacting apparatus, that is at the operative temperature, operating the pressure plates of both the sides of the apparatus, in such a way that they press and move the material contained therein, said steps being cyclically repeated until reaching the set filling grade.

BRIEF DESCRIPTION OF THE DRAWING

The present invention will be now described, for illustrative but not limitative purposes, according to its preferred embodiments, with particular reference to the figures of the enclosed drawings, wherein.

DESCRIPTION OF THE PREFERRED EMBODIMENTS

Figure 1:
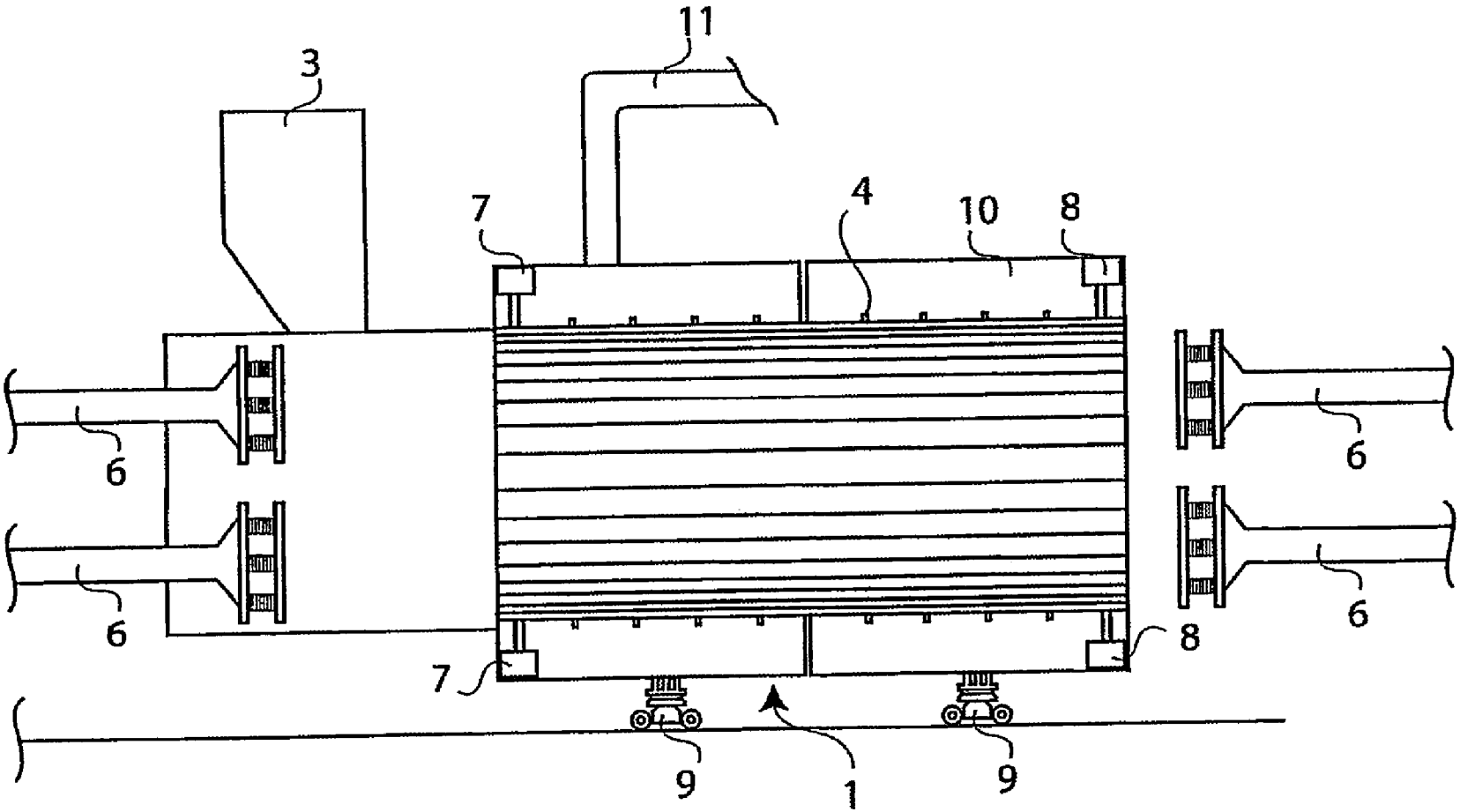
FIG. 1 shows a longitudinal section of a schematic lateral vertical view of an apparatus according to the present invention.
Figure 2:
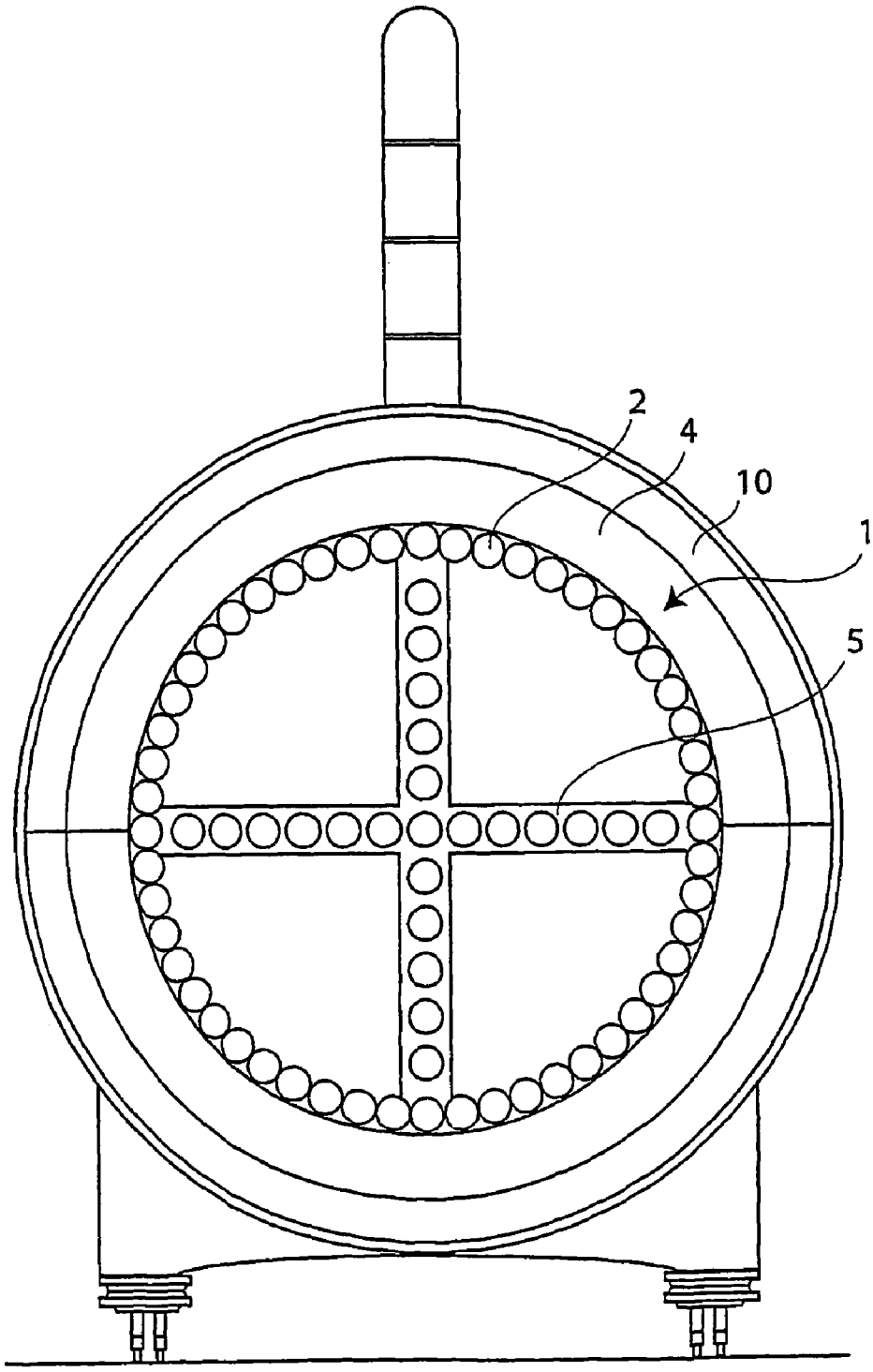
FIG. 2 shows a cross-section of a schematic front vertical view of the apparatus of FIG. 1.
Figure 3:
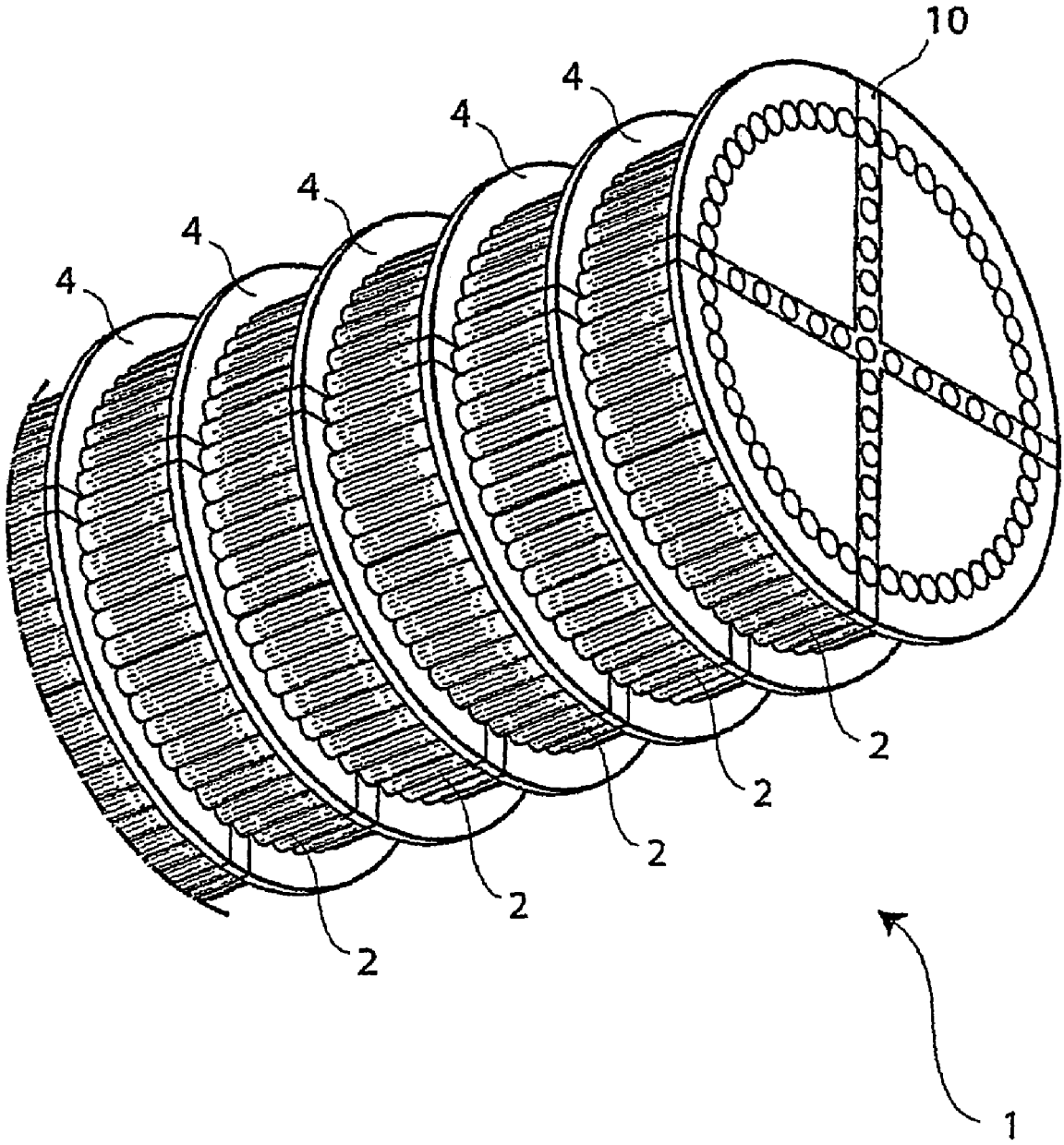
FIG. 3 shows a perspective view of the particular of the cylindrical body cage of the apparatus of FIG. 1.

Making reference to the figures, it can be observed the main body of the drying—compacting apparatus of the invention comprising a cylindrical body 1, made up of an assembly of tubes 2 coursed by a thermal carrier fluid, said tubes 2 being positioned according to the generatrixes of the cylinder. Thus, within the tubes 2 a cylindrical space is realised, said space being divided into four equivalent sections by further tubes, coursed by the thermal carrier fluid, said further tubes being arranged according to a cross position. Wastes to be compacted and dried are discharged from above into the apparatus, within a loading chamber close to one of the basis of the cylindrical body, by a hopper 3. By the heat exchanged among the tubes, apparatus warms the discharged wastes, acting as an oven.

Furthermore, in view of the good features of the tube to act as beams, they are dimensioned and constrained in such a way that the cylindrical shaped lateral body acts also as bearing structure for the material to be subjected to treatment, structure able to support the pressure and thermal stresses developed during the operation of the apparatus.

Tubes 2 comprising the cylindrical body and that further divide it into four sections are coursed by a thermal carrier fluid at 170-190° C.; they are coupled each other by retaining rings 4, the tubes comprising the lateral cylindrical body and by cross-shaped retaining plates 5, the tubes dividing the cylindrical body into four sections. Said retaining rings 4 and said retaining plates 5 are realised with a given distance between centres to ensure the stability of the tubes subjected to radial thrust by the pressed material and by thermal gradients. These retaining structures have a seat designed on the basis of the profile of the same tubes.

Longitudinal axial thrust exerted for compacting the wastes contained within the cylindrical body 1 is exerted pressing on both opposed sides of the material mass by four pairs of pressing plates 6, suitably shaped to be introduced within the inner space of each section of the cylindrical body and particularly provide, in correspondence of the lateral wall, of the cusps inserted within the space between two adjacent tubes.

Tubes 2 communicate with inlet 7 and outlet 8 manifolds of the diathermic fluid coupled by flexible tubes with the outer part of the cylindrical body of the cage drying—compacting apparatus not to hinder the movement of the pressure plates 6, acting as pistons within the different sections of the cylindrical body 1. Particularly, inlet and outlet manifolds are alternated in such a way that the inlet side of each tube corresponds to the outlet side of the adjacent tube.

Cage cylindrical body is mounted on ground constraints comprised of slidable pads 9, suitably realised in such a way to create an statically indeterminable labile structure to minimise the effects due to the stresses due to the high thermal gradients developed, as well as the longitudinal thrusts due to the compression forces exerted by the pressure plates 6.

Basic element of the present invention is the particular geometrical position of the tubes 2 acting, as already said, as heat sources and containing structure. They are placed according two different functions, mostly along the generatrixes of the cylindrical body, suitably spaced each other in such a way to leave a series of longitudinal slots between adjacent tubes, necessary to let the vapour exiting; the remaining part according two direction perpendicular each other, to realise a cross dividing said cylindrical body into four equivalent sections, spaced each other.

Longitudinal slots along the lateral wall of the cylindrical body 1 are very efficient not only as vapour escape ports, but also as element helping the heat exchange between tubes 2 and the material to be subjected to treatment, due to the cusps section, decreasing outward, in such a way to offer to the material advanced by the pressure a gradual and growing resistance, ending when the compression forces are stabilised at the design values, guaranteeing the "not exit" of the material subjected to treatment.

Cross positioned tubes within the cylindrical body are in the middle of the waste mass: they will be in touch with the material to be subjected to treatment for a part of their surface far bigger than the part of the tubes comprising the cylindrical body, each tube facing on two different sections of the apparatus. Consequently, the thermal exchange surface of these tube for the heat transferred by the thermal carrier fluid to the material to be subjected to treatment increases.

Furthermore, the division into sections creates a plurality of cages having an equivalent diameter smaller than the diameter of the main cylindrical body: the smaller transverse area of each section allows to reach a higher heat transmission efficiency to the refuse mass. Consequently, treated mass temperature reaches the design values in a shorter time.

Assembly of cylindrical body 1 is enclosed within a thermo-insulating case 10, acting as manifold of vapour releasing said escape ports, that is under depression conditions, through a duct 11 by a motion-condensing unit, working according to a closed cycle, so that the system as no influence on the outer environment or on the working environment.

Structure of the drying—compacting apparatus according to the present invention also allows to obtain a better resistance of the device to the mechanical and thermal stresses, since the tubes act as very resistant beams, even if having a small thickness.

As first consequence, drying—compacting apparatus can be realised by low and medium mechanical resistance materials, being it sure that, differently with respect to the high mechanical resistance materials, to be able to solve the problems relevant to the general corrosion that, finally, can be controlled by a suitable over-sizing of the structures.

By this aspect, it is understood that surface treatments suitable to confer to the tubes resistance to abrasion are made possible thanks to the possibility of using basso-low-bonded steels.

Furthermore, it is also possible to entrust to the cage drying—compacting apparatus also the pressing work that in the known systems is carried out within the compacting section at room temperature upward the oven.

Elimination of the pre-treatment section allows by the loading means of the waste and suitable arrangement to adjust the recovery of the treated material, to continuously operate the system.

Loading of the apparatus, during the start of the operation, provides heating the oven making the thermal carrier fluid flowing at the design temperature within the tubes, thus having a three step cyclic run, the first one of which resides in withdrawing the pressure plates 6 up to the relevant death ends, in such a way not to prevent the insertion of the material to be subjected to treatment. Second step involves the introduction of the wastes let falling down, in a reduced amount with respect to the capability of the same apparatus, from hopper 3 into the loading chamber. Thus the hopper throat is closed and the pressure plates 6 push the material within the cylindrical body 1 from both sides, pressing and pushing it within the drying—compacting apparatus according to the direction of the side opposite with respect to the inlet one.

This operation is repeated until a filling compatible with the design data is reached, said data being set on the basis of engineer calculations taking into consideration the inner and outer friction coefficient of the material (and thus of its nature and size) and of the residence time within the apparatus necessary to its inertisation (that is a function of the humidity of the material to be subjected to treatment and of the required residual humidity).

During this filling phase, thermal carrier fluid is always maintained at set running temperature values. Thus, variations of the thermal run are avoided, with a consequent energetic saving and reduction of the corrosion processes.

After this first step, already involving a certain advancement of the compacting and drying operation of the material, starts the set running operation of the apparatus.

It must be taken into account that, all along its length, the drying—compacting apparatus according to the invention realises an environment wherein each portion has the same temperature of the upward portion and of the downward portion. It involves that heat can be transferred in the same way both to the material to be subjected to treatment on fixed co-ordinates on the apparatus, and to material moving with respect to the apparatus, passing from the loading throat to the outlet throat.

Each new loading of material within the apparatus will be subjected to the following treatment, comprised of an introduction step, a treatment step, that is repeated for a total number of cycles depending on design parameters and treated material withdrawal step.

During the introduction step, material to be subjected to the treatment is let falling from the hopper 3 within the loading chamber, while the pressure plates 6 are in correspondence of the relevant lower death points. Thus, the charge, herein described as reference, is pressed by the pressure plates 6, inlet side, within the cylindrical body 1 of the apparatus, against the part of material previously introduced, that is then pressed by the relevant pressure plates on the exit side.

Then, plates on the exit side withdraw and all the material is advanced toward the exit, a part of the material arriving close to the outlet throat and being withdrawn.

Afterwards, also the plates on the inlet side withdraw and a new charge is let falling down within the loading chamber, is pushed within the cylindrical body and is compressed against the reference charge, introduced in the previous cycle, and along with the same against all the material previously introduced, thus contributing first to press it and then to move it toward the exit.

After a certain number of cycles, during which it continues to dry by the transfer of heat operated by the thermal carrier fluid through the exchange surface of the tubes, the reference charge comes close to the exit and is withdrawn.

In this way, varying the number of cycles of the refuses within the apparatus, i.e. varying the length of the amount of charge introduced each time, it is possible to continuously subject the material to treatment, until reaching the wished drying and pressing level.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. Cage drying—compacting apparatus for wastes, comprising:

a cylindrical body and at least a pair of pressure plates;

a peripheral wall of said cylindrical body consisting of heating longitudinal tubes, carrying a thermal carrier fluid, provided along a generatrix of the cylinder and spaced from each other to provide longitudinal slots for outlet of vapor but not for outlet of material, wherein steam generated by heating the wastes is discharged through the longitudinal slots between said heating tubes, said tubes being retained by plural retaining rings spaced from each other along a length of said tubes;

said pressure plates being placed opposed to each other, operating as movable basis of said cylindrical body and acting as pressing pistons;

further heat sources, provided inside the cage drying—compacting apparatus, all along its length, said further heat sources being comprised of at least one tube through which the thermal carrier fluid runs;

means for inlet of the material to be subjected to treatment, in a position close to one of the two ends of the apparatus; and means for collecting the material subjected to the treatment, in correspondence of the opposed end.

2. Drying—compacting apparatus according to claim 1, wherein said further heat sources comprise a plurality of tubes carrying the thermal carrier fluid and placed aligned, spaced each other, in such a way to divide the inner volume of the cylindrical body into sections connected to each other, each said section being provided with a pair of opposed pressure plates, shaped on the basis of the shape of the respective said section.

3. Drying—compacting apparatus according to claim 1, wherein said further heat sources comprise a plurality of tubes carrying the thermal carrier fluid and placed aligned, spaced from each other, to allow the passage of the material to be subjected to treatment, in such a way to divide the inner volume of the cylindrical body into four equivalent sections connected to each other, each said section being provided with a pair of opposed pressure plates, shaped on the basis of the shape of the respective said section.

4. Drying—compacting apparatus according to claim 1, wherein said pressure plates are shaped in such a way that the profile faced toward the outer surface of the cage has a profile with cusps corresponding to the spaces between two adjacent said tubes.

5. Drying—compacting apparatus according to claim 1, wherein said further heat sources are constrained by a containment structure, comprised of a plurality of constraint plates provided at a set distance from each other.

6. Drying—compacting apparatus according to claim 1, further comprising inlet and outlet manifolds for said tubes, coupled by flexible joints, in such a way to allow a uniform distribution of the fluid within the tubes.

7. Drying—compact apparatus according to claim 6, wherein said inlet and outlet manifolds are provided in such a way that a flow direction within each of said tubes is opposite a flow direction in a directly adjacent one of said tubes.

8. Drying—compact apparatus according to claim 1, wherein said means for inlet of the material to be subjected to treatment comprise a loading hopper, from which refuses fall within a loading chamber at the inlet end of the cylindrical body.

9. Drying—compacting apparatus according to claim 1, further comprising a thermo-insulating material case, tightly containing said cylindrical body, having a manifold function for the vapor exiting from said longitudinal slots and a closed cycle motor-condensing unit.

10. Drying—compacting apparatus according to claim 1, wherein said plural retaining rings are mounted on a series of resting and sliding means for reducing effects due to stresses deriving from the high thermal gradients, as well from the radial thrusts due to the compression forces exerted by the opposed pressure plates.

11. Process of compacting and drying wastes by a drying—compacting apparatus as defined in claim 1, comprising the following steps:

withdrawing the pressure plates of both sides of the apparatus up to the respective said two ends of the apparatus;

introducing within the drying—compacting apparatus, at the operative temperature, already containing an amount of refuses left from a previous cycle, a set loading amount of material to be subjected to treatment, operating the pressure plates of the material inlet side, in such a way that they press the introduced material with the new charge against the material already present within the cylindrical body of the drying-compacting apparatus, thrusting it in such a way that a fraction of the material, at the end opposite with respect to the inlet one of the material is made to exit, withdrawing the pressure plates from the side of inlet of the material up to the respective one of said two ends of the apparatus, taking the amount of material exited from the apparatus, operating the pressure plates of both the apparatus sides, in such a way that they will press the material therein, repeating the cycle.

12. Process of compacting and drying wastes according to claim 11, comprising the following steps, starting from an empty apparatus:

making the thermal carrier fluid flowing within the tubes, to reach the operative temperatures, withdrawing the pressure plates of both sides of the apparatus, introducing a batch of the waste to be subjected to the treatment within the drying—compacting apparatus, that is at the operative temperature, and operating the pressure plates of both the sides of the apparatus, in such a way that they press and move the material contained therein, said steps being cyclically repeated until reaching the set filling grade.

* * * * *